US006467629B1

(12) United States Patent
Exner

(10) Patent No.: US 6,467,629 B1
(45) Date of Patent: Oct. 22, 2002

(54) APPARATUS AND METHOD FOR SEPARATING PARTICLES WITH A ROTATING MAGNETIC SYSTEM

(76) Inventor: Hurbertus Exner, Am Zauberberg 2a, D-38667 Bad Harzburg (DE)

( * ) Notice: Subject to any disclaimer, the term of this patent is extended or adjusted under 35 U.S.C. 154(b) by 0 days.

(21) Appl. No.: 09/798,591

(22) Filed: Mar. 3, 2001

Related U.S. Application Data

(63) Continuation of application No. 09/180,801, filed on Nov. 16, 1998, now Pat. No. 6,230,897.

(30) Foreign Application Priority Data

May 17, 1996 (DE) ..... 196 19 760
Aug. 19, 1996 (DE) ..... 196 34 802

(51) Int. Cl.[7] ..... B03C 1/00

(52) U.S. Cl. ..... 209/219; 209/225; 209/212; 209/213; 209/636; 209/695; 209/639; 209/689

(58) Field of Search ..... 209/636, 639, 209/689, 695, 696, 213, 217, 218, 219, 225, 226, 228, 227, 212, 932; 198/458, 439, 440, 441, 619, 679, 836.1, 752.1, 759, 769, 771

(56) References Cited

U.S. PATENT DOCUMENTS 1,488,707 A * 4/1924 Parrish et al. ..... 198/523

FOREIGN PATENT DOCUMENTS

| | | | |
|---|---|---|---|
| EP | 0439983 A2 | * | 12/1990 |
| EP | 0439983 | * | 12/1990 |
| JP | 52-074170 | * | 6/1977 |
| JP | 57-119856 | * | 7/1982 |

* cited by examiner

*Primary Examiner*—Donald P. Walsh
*Assistant Examiner*—Jonathan R Miller
(74) *Attorney, Agent, or Firm*—Barlow, Josephs & Holmes, Ltd.

(57) ABSTRACT

An apparatus for separating mixed particles divides the material to be sorted into constituent fractions comprising non-ferromagnetic particles of different electrical conductance. The particles are fed onto a conveyor, e.g. a conveyor belt that linearly moves the particles in a given direction. A rotating magnetic system is arranged below and/or above the conveyor belt. The rotary direction of the magnetic system is chosen so that the direction of movement of the surface of the magnetic system and the direction of movement of the surface of the conveyor belt are different. The fractions of non-ferromagnetic particles that are electrically charged to varying degrees are thereby divided between a plurality of collecting containers.

24 Claims, 9 Drawing Sheets

APPARATUS AND METHOD FOR SEPARATING PARTICLES WITH A ROTATING MAGNETIC SYSTEM

CROSS-REFERENCE TO RELATED APPLICATIONS

This application is a continuation of U.S. Ser. No. 09/180,801, filed Nov. 16, 1998 now U.S. Pat. No. 6,230,897.

BACKGROUND OF THE INVENTION

The invention relates to an apparatus and a method for separating particles of material of different electrical conductance. More specifically, the mixed particles are fed onto a conveyor and separated by a rotating magnetic system arranged on the conveyor. A collecting container collects the sorted particles that are separated from the remaining material on the conveyor.

In an apparatus of this type known from U.S. Pat. No. 3,448,857, a quantity of particles of different electrical conductance, which have to be sorted, is fed onto a conveyor belt from above. The conveyor belt turns over a belt drum and takes the particles to that drum at a speed of 1 to 1.5 m/sec. A magnetic system rotates in the belt drum at a speed of approximately 1500 r.p.m. A relative movement takes place between the conveyor belt and the drum with the magnetic system during operation, and the difference in speed makes the magnetic lines of force cut through the electrically conductive particles traveling on the belt. Currents are thereby induced of a strength dependent on the electrical conductance of the particles. A stronger current is generated in the particles with higher electrical conductance, and causes those particles to be thrown in a trajectory from the belt into their direction of movement. The particles with lower electrical conductance remain near the belt and drop off it almost vertically. The exact fraction, which has a certain required electrical conductance, may be filtered out by installing a collecting container at a suitable location. It should be noted that before the '857 apparatus is used, ferromagnetic materials have already been picked out of the material to be sorted by methods which are sufficiently well known (strong magnets). The main function of the '857 apparatus is in fact to separate so-called nonferrous metals (copper, aluminum, lead, zinc, brass etc) from residual materials (paper, plastic, glass etc) particularly in connection with waste recycling.

An apparatus for separating mixtures of materials with different electrical conductance including a similar rotating magnetic means is known from DE 34 16 504 AI. In this apparatus, the magnetic means rotates rapidly and produces a changing magnetic field through which the mixed particles are passed. The separating means is surrounded by a case, which rotates more slowly. The eddy currents arising have effects on the particles, giving the electrically conductive particles a greater trajectory than the non-conductive ones.

PCT Patent Publication No. WO 89/07981 shows a comparable construction. Here again materials made up of non-magnetic particles drop from above onto a rotating drum containing a magnetic system that also rotates. The drum and the magnetic system rotate in opposite directions so that non-metallic materials such as glass, plastic and stones drop down on one side of the drum and non-magnetic metals on the other side. However, constructions in accordance with DE 34 16 504 AI or WO 89/07981 only allow non-specific separation, and the number of incorrectly separated particles is relatively high. Magnetic particles, which have not been previously separated out, also pose a problem, and may cause damage on going between the drums and the cases rotating in the other direction.

As a further improvement to such apparatus EP 0 339 195 BI proposes that the magnetic system should be arranged eccentrically in the belt drum. This arrangement prevents magnetisable, electrically conductive particles from being held between the conveyor belt and the belt drum. These trapped particles become red hot as a result of the magnetic field and inflict corresponding damage to the belt drum and conveyor belt. Another eccentric arrangement is shown in Japanese Patent Publication JP57-119856 A.

It has already been proposed in German Patent Publication DE 4 323 932 CI that the speed of the drum of the magnetic system should be raised and the deflection thus made stronger in order to improve sorting quality. However, this necessitates correspondingly expensive improvement of the properties of the magnetic system.

SUMMARY OF THE INVENTION

The problem of the invention is to provide an apparatus of the above type and a corresponding method, which improve sorting quality even without increasing the speed, or if the speed is increased, also increase the quality of the sorting.

The problem is solved in the present invention by providing an apparatus wherein the rotary direction of the magnetic system is chosen so that the directions of movement of the surface of the magnetic system and of the conveyor are different.

The problem is solved in the present invention by a sorting method wherein the surface of the magnetic system and the particles to be sorted are moved in different directions.

With the various components in such relative positions the sorting quality can be decisively improved. In known metal separators, the conveyor belt is used only to bring the particles which have to be sorted to the actual sorting point, i.e. the magnetic system; the magnetic system then decides, from the size of the parabolic trajectory formed, whether the particle is to be regarded as electrically more conductive or less conductive and hence whether it shall drop into a certain collecting container or not. This may sometimes cause problems and incorrect assessments, for example when particles lie over or cover each other and thus interfere with each other through the flight parameters.

In the present invention, the highly electrically conductive particles move in a different direction from the less conductive particles (not just to a different degree in the same direction, as in prior art); the limit can be set very sensitively here through the strength of the magnetic field of the magnetic system and/or the speed of the conveyor belt. The conveyor belt causes a basic movement of all the particles in a certain direction, and this is counteracted by the magnetic field of the magnetic system. The magnetic field may be made strong enough to move the highly conductive particles against the action of the conveyor belt, in the opposite direction, without any problems. In one embodiment, the start of the parabolic trajectory begins directly above the magnetic system such that some of the affected particles will have no further contact with the belt if they are caught and deflected sensitively enough above it.

In another embodiment, a certain section of conveyor belt is thoroughly and deliberately taken into account. Here again the magnetic field is found to be strong enough to convey the particles over the end of the upper run into a collecting container installed there.

If particles, possibly of different specifications, are on top of each other, mixed up or possibly diffused into each other, they will be disentangled or also spun to and from on the conveyor belt by forces acting in different directions, and will consequently be detached from each other; the effect can be seen immediately in the case of superimposed particles.

Instead of simply traveling along subtlety different parabolic trajectories, the particles move in diametrically opposite directions and therefore cannot interfere with each other.

If two particles landing in adjacent positions move diametrically towards each other and meet, this still does not diminish the sorting quality. After the impact, they will reappear unchanged in the same position, but in a slightly different relative arrangement, and will then automatically move in the right direction at the second attempt. Conveying and sorting of a particle in an incorrect direction is thus prevented.

In contrast with constructions where a case rotates around the magnetic system instead of an additional conveyor, the sequence in the present invention is that the particles to be separated are given a finite dwell time in the magnetic region, during which they are still accessible to decisions and influences. If a second drum is used instead of the conveyor, any initial incorrect classifications will generally be maintained, e.g. because pairs of elements may be hooked together.

A conveyor other than a belt may be used, e.g. a channel conveyor on which the particles are moved forwards by vibration or simply by gravity. Here the effects are similar.

A feed means is preferably provided for supplying the material to be sorted to the conveyor. The feed means may itself be a belt or channel conveyor. Again, it is preferable for the area adjacent the feed point to be made of a nonconductive material such as a plastic. In this way, a certain influence is exerted on the particles of material shortly before the feed point, and their dwell time under the influence of the magnetic system, which is conducive to their precise movement and assessment, is further lengthened. The conductive particles are found to orient themselves even while they are dropping onto the feed point and to move purposefully in the desired direction even before they land there.

In a particularly preferred embodiment, the directions of movement obtained in this manner are substantially perpendicular to each other. This means that the axis of rotation of the magnetic system is substantially parallel to the conveying direction of the belt or channel conveyor or alternatively at a relatively small angle thereto; the magnetic system thus rotates across and below the conveyor, thereby moving its surface substantially perpendicular to the direction in which the particles in the channel conveyor are conveyed. As a result, the forces acting on the nonferrous metals lead to strong movement of those metals, driving them away from the channel conveyor or to one side of it, while the ordinary non-metallic particles are unaffected. This effect may be utilized to drive non-ferrous metals down over the edge of the belt or channel conveyor and catch them in a collecting container there. Combinations of these various ideas are also possible.

The idea behind all the above-mentioned rotating magnetic systems is merely to separate all the non-ferrous metals from other waste such as glass or plastic and thus allow justifiable recycling. The accuracy of the operation did not permit any other separation. The parabolic trajectories of heavy but highly conductive copper parts and those of light but relatively non-conductive aluminum parts, or even those of pieces of glass with rolling motion components are similar and merge into each other, thus posing a problem in the past.

Separation of different metal components in a material to be sorted is therefore avoided as far as possible or, if absolutely essential or required, is carried out manually or by very expensive processes such as flotation in suitably conditioned liquids with precisely set specific densities. However, apart from being costly, this produces polluted liquids, which are expensive to dispose of, and wetted non-ferrous metals (again with problem constituents which have to be cleaned off).

According to the invention however, even these non-ferrous metals can be separated from each other. This is particularly possible in an embodiment where the conveyor has a conveying direction substantially parallel with the axis of the rotating magnetic system, and the conveying takes place in a channel conveyor above that system. The channel conveyor is preferably arranged not centrally above the magnetic system, but slightly offset, even if it overlaps it.

The channel conveyor should be slightly inclined transversely to the conveying direction, with the lowest point at the side remote from the magnetic system. The side towards the magnetic system or towards the centerline in its surface is either open, or forms an accumulating edge.

This particular shape enables the relative differences e.g. between two nonferrous metals to be utilized. For example, copper has high conductance and relatively high specific gravity, whereas aluminum has relatively low conductance and also low specific gravity. So copper particles are relatively difficult to accelerate despite the strong influence of the magnetic field. In fact it is found in practice that, if the channel conveyor is appropriately inclined, and also laterally and vertically spaced from the central axis, all the aluminum particles can be sluiced out from the side of the conveyor across the magnetic system before the copper particles are also sluiced out.

This is aided by the fact that the particles of material to be sorted tend to accumulate at the lower edge of the channel conveyor; that is to say, small, easily accelerated particles move along further away from the magnetic field, while larger and thus heavier and less easily accelerated particles continue to extend into it.

This also applies to mixtures including other components. Not only do aluminum particles appear relatively frequently in standard material requiring sorting, but out of all the materials studied they have the most favorable combination of specific gravity (or more precisely density, i.e. ratio of mass to volume) and conductance; they are therefore sorted out of such non-ferrous metal material first, after which the parameters are changed until they are sufficient for sluicing out the next component in question, and so on. This may be done not only by passing the material through repeatedly but also by arranging a sequence of different channel conveyor sections, so that different non-ferrous metals are then sorted out in turn in different lengths of the rotating cylindrical magnetic system. A further opportunity is obtained if the cross-section of the channel conveyor across the conveying direction has a non-level base, particularly a base with the highest point in its central region. With cross-sections of this type which are not level in the conveying direction an additional effect is obtained which helps to disentangle particles and also tends to separate them according to the ratio of density to specific conductance. Initial slightly incorrect orientation of the particles caused by hooking together can easily be rectified however, merely by turning them slightly, as the particles are under the influence of the various forces for a certain time.

It is particularly preferable for the base to match the shape of the drum. If the drum rotates with the magnetic system, with its axis parallel with the conveying direction, the base, curved upwardly as a segment of a circle, may be arranged a relatively short distance above the drum. This means in particular that the magnetic field may be exploited very effectively, that is to say, it is used particularly effectively and may be made relatively smaller and also obtain the same effect.

Another preferred effect is obtained if a fluid is applied in a region above the magnetic system, as an addition to these or other embodiments. The various materials can thus be separated in a still more detailed way, particularly if the fluid is applied in doses, perhaps from an air nozzle, and especially when the constituent materials of the particles are already known from the charge supplied, so that the forces which will be generated by the magnetic system, the conveying action of the channel conveyors or belt and by the air nozzle or other fluid applying means (on the basis of the specific weight and shape of the particles) can therefore be specified. The effect may be improved by providing a rotating magnetic system both above and below the conveyor. The axes of the two systems are parallel and the rotary direction is such that the direction of movement in the surface regions of the two systems facing each other is the same. The magnetic field formed there is thus particularly stable and unambiguous for the particles, which pass through between the systems on the conveyor. A particular effect of this arrangement is that particles which already have a certain motion component of their own or are difficult to bring under control, e.g. because they rebound in an irregular manner, can also be sorted reliably.

One of the basic ideas of the invention is that the dwell time of a single particle of the material in the magnetic field should be lengthened as much as possible. In prior art the dwell time is an extremely brief moment during which the particles drop onto the conveyor belt from above, whereas in the present invention, the time is considerably lengthened so that the particles have far more opportunity to move into the correct sorting path in a structured manner under the influence of the controlling magnetic field.

Other features and advantages shall become apparent as the description thereof proceeds when considered in connection with the accompanying illustrative drawings.

BRIEF DESCRIPTION OF THE DRAWINGS

The invention will now be described in greater detail with respect to the accompanying drawings wherein.

DETAILED DESCRIPTION OF THE PREFERRED EMBODIMENT

The purpose of the process can be seen clearly in all the embodiments illustrated. To begin with, material 1 to be sorted, comprising a mixture of particles of varying electrical conductance, is fed in from above. In these purely diagrammatic drawings, the particles 2 with high electrical conductance are shown as solid triangles, while the particles 3 with low electrical conductance are represented by outline circles. At the end of the process, the particles 2 with high conductance and the particles 3 with low conductance are separate and reappear in different positions.

Figure 7:
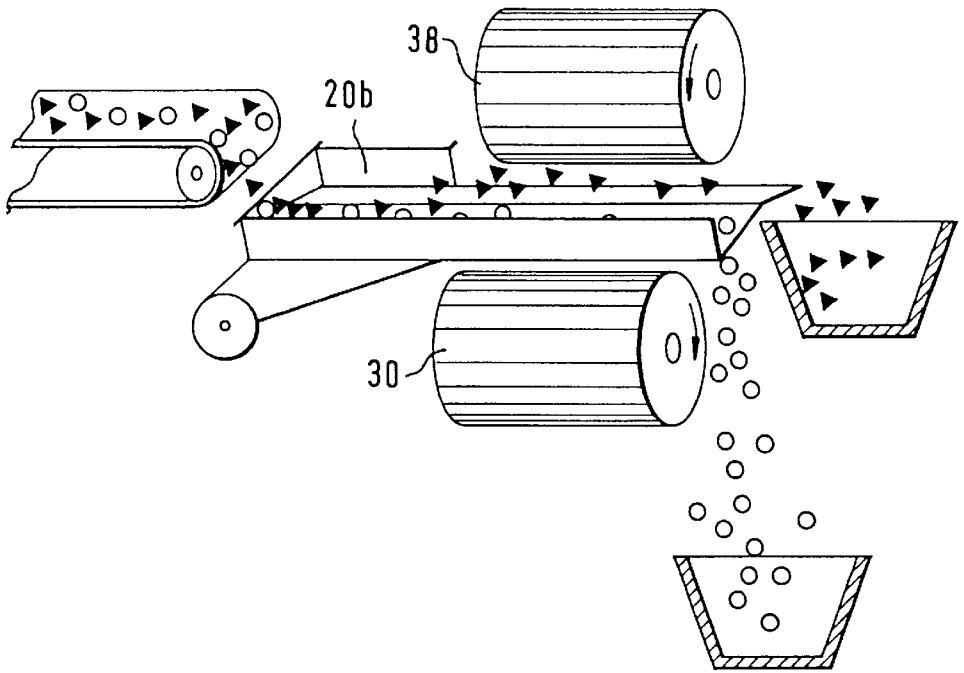
FIG. 7 is a diagrammatic perspective view of the FIG. 6 embodiment.
Figure 6:
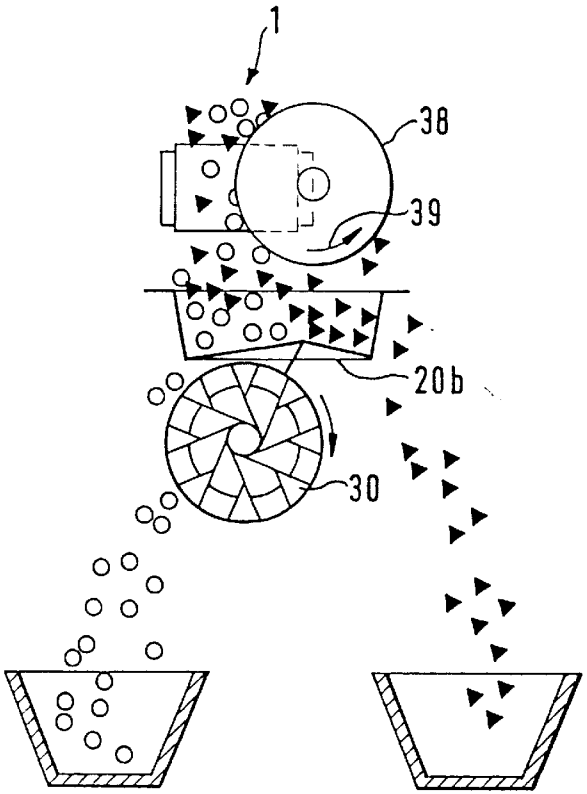
FIG. 6 is a diagrammatic representation of a fifth embodiment in section.
Figure 8:
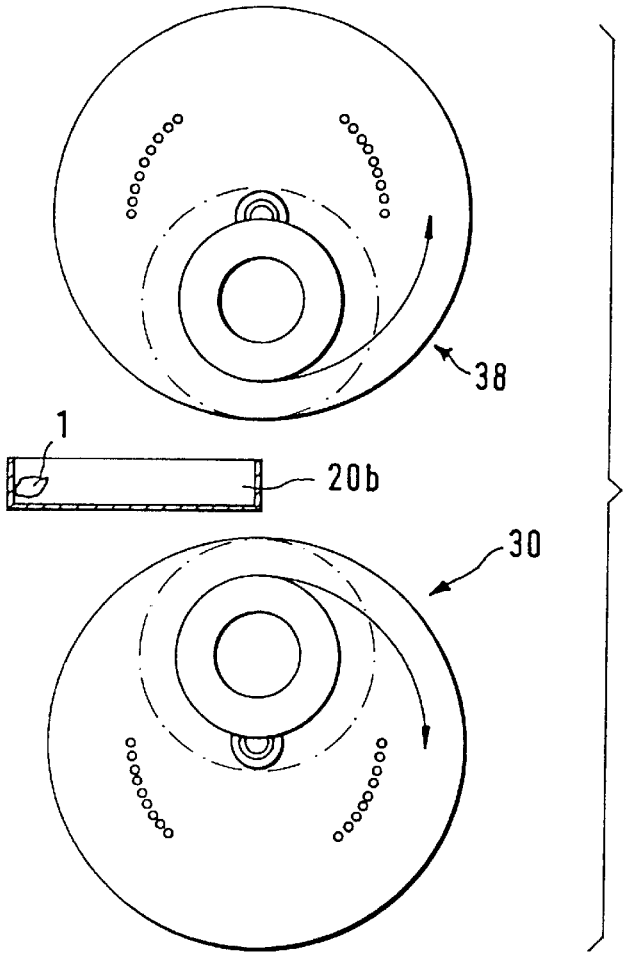
FIG. 8 is a section through a detail from FIG. 6 on a larger scale.
Figure 9:
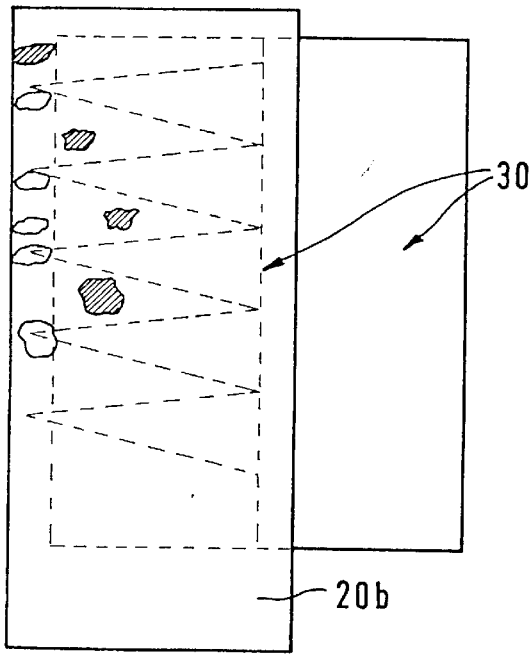
FIG. 9 is a plan view of a detail from FIG. 6.

Firstly, a charging means 11 can be seen at the top left-hand side, whereby the material 1 to be sorted is transferred to a channel conveyor 15. The function of the conveyor 15, which may be a vibrating channel, is to even out the flow of material and possibly extract undesirable components from the outset. Instead of a channel conveyor 15 there may be a conveyor belt 15*b* as in the FIG. 4 or FIG. 7 embodiment.

Ferrous metals may, for example, be taken out in this area, as they might cause trouble during the subsequent separation of non-ferrous metals from plastics and other electrically non-conductive or hardly conductive materials in accordance with the invention. On the one hand, ferrous metals can be removed relatively easily owing to their ferromagnetic properties, and there are many known devices that may be used for this purpose. On the other hand, these very properties of extremely strong magnetism interfere with further differentiation.

The channel conveyor 15 or conveyor belt 15*b* then feeds the material 1 to be sorted, in its still unsorted condition, to a conveyor 20. In the embodiments in FIGS. 1–3, this is a belt 20*a* and in the FIGS. 4–5 or FIGS. 6–9 versions, this is a channel conveyor 20*b*. From this position onwards, there is a difference between the embodiments (a) in FIG. 1, (b) in FIGS. 2–3, (c) in FIGS. 4–5 and 6–9, and (d) FIGS. 10–14.

Figure 1:
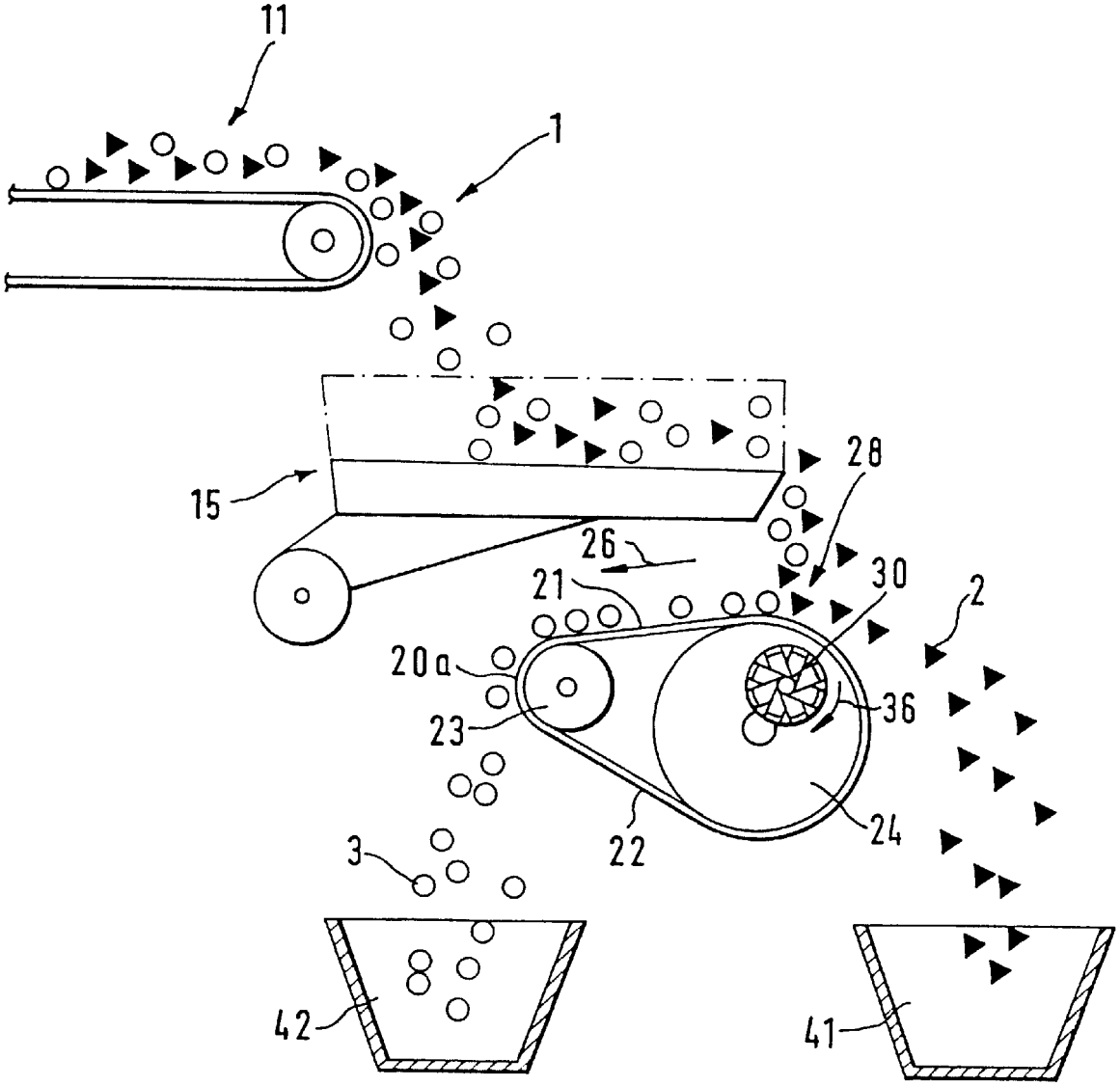
FIG. 1 is a diagrammatic side view of a first embodiment.

In FIG. 1 the conveyor belt 20*a* comprises an upper run 21 and a lower run 22 and moves over two drums 23, 24. It is driven and moves counter-clockwise in the view shown, with the upper run 21 of the belt going to the left in the direction 26. The feed point 28, around which the particles of material 1 fed from the channel conveyor 15 land on the surface of the conveyor belt 20*a,* is above the right-hand drum 24 in FIG. 1. The magnetic system 30 is located inside the drum 24 but eccentrically from its axis and very precisely below the feed point 28. It may, for example, be constructed in accordance with DE 4 323 932 CI or in a different, traditional form. The system 30 shown is shaped as a cylindrical drum with a horizontal axis of rotation and with the drum turning clockwise. The direction 36 in which the surface of the magnetic system 30 moves in the area below the feed point 28, i.e. below the conveyor belt 20*a,* is thus exactly opposite the direction 26 in which the conveyor belt 20*a* moves in that area.

A particle of either higher or lower electrical conductance which drops off the channel conveyor 15 onto the conveyor belt 20*a* will therefore be subject to the effect of two forces above the belt 20*a:* firstly the flows induced by the magnetic lines, tending to pull it to the right in FIG. 1, and secondly the frictional forces of the belt 20*a,* tending to move it to the left. If the particle is relatively highly conductive, the magnetic forces will prevail and will convey it in a parabolic trajectory to the right, into a collecting container 41 standing in that position. If the ratio of the electrical conductance of a particle to its density is very low and the extracting force therefore weak, the particle is carried along by the conveyor belt and will then drop into a second collecting container 42, which is kept ready at the end of the conveyor in the region of the drum 23.

Any particles which are hooked together, lie on top of each other or impede each other will spend a certain time above the still rotating magnetic system 30, and thus under the influence of the two above-mentioned forces. The forces naturally act in different directions on such particles, causing them to be disentangled and finally conveyed away in the correct directions. Even if a particle has started moving in the wrong direction, possibly through a small particle of one kind being entrained by a larger particle of the other kind, the effect of the two forces acting over a corresponding distance and thus a corresponding time is to reverse the movement, so that the entrained particle can move in the right direction once freed from the other particle. Thus, incorrect separation is still reversible up to a certain point, unlike the situation when a separating wall is used.

If the particle is a ferrous metal, i.e. a ferromagnetic material, it is attracted by the magnetic system. It moves with the conveyor belt and hence with the less conductive particles and is thus separated from the non-ferrous metals. If desired, it may be separated from the less conductive particles, as it tends to remain on the belt through magnetic attraction. However ferrous metals can be extracted differently, and this is preferably done at a preliminary stage.

Figure 2:
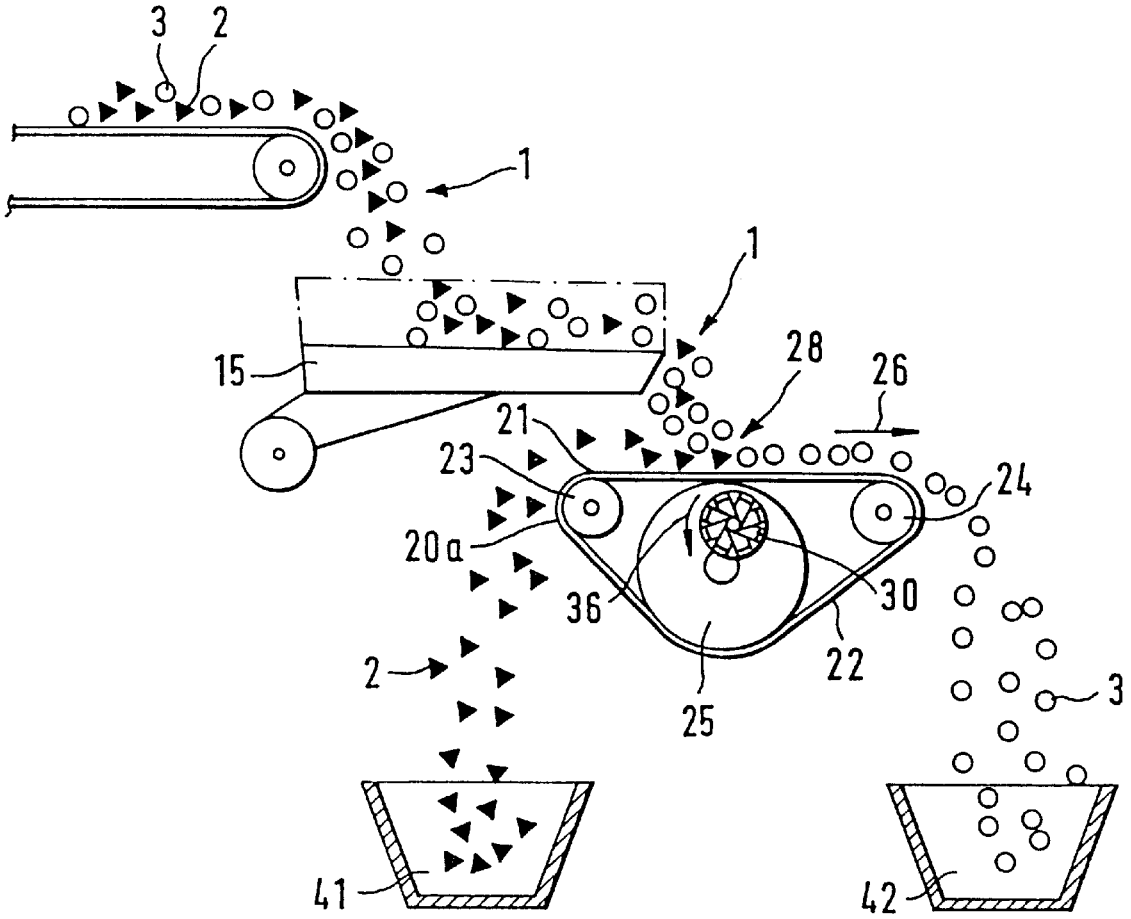
FIG. 2 is a diagrammatic side view of a second embodiment.

In FIG. 2, the mode of operation is the same as in FIG. 1, although the conveyor belt 20*a* with its upper run 21 and lower run 22 is guided around three drums 23, 24 and 25 and is held by the two outer drums 23 and 24. The magnetic system 30 is located —again eccentrically —in the largest, central drum 25. Unlike the first embodiment, the direction of movement 26 of the conveyor belt shown here is to the right, while the direction of movement 36 of the surface of the magnetic system 30 is to the left, i.e. in the opposite direction. Here, the feed point 28 for the particles 2,3 of material 1 to be sorted is located slightly more centrally on the conveyor belt 20*a,* though also above the magnetic system 30. The conveyor belt, or the forces exerted thereby, thus has a somewhat longer-lasting effect on the electrically conductive particles 2, which were moved more or less directly into a parabolic trajectory in the first embodiment.

Figure 3:
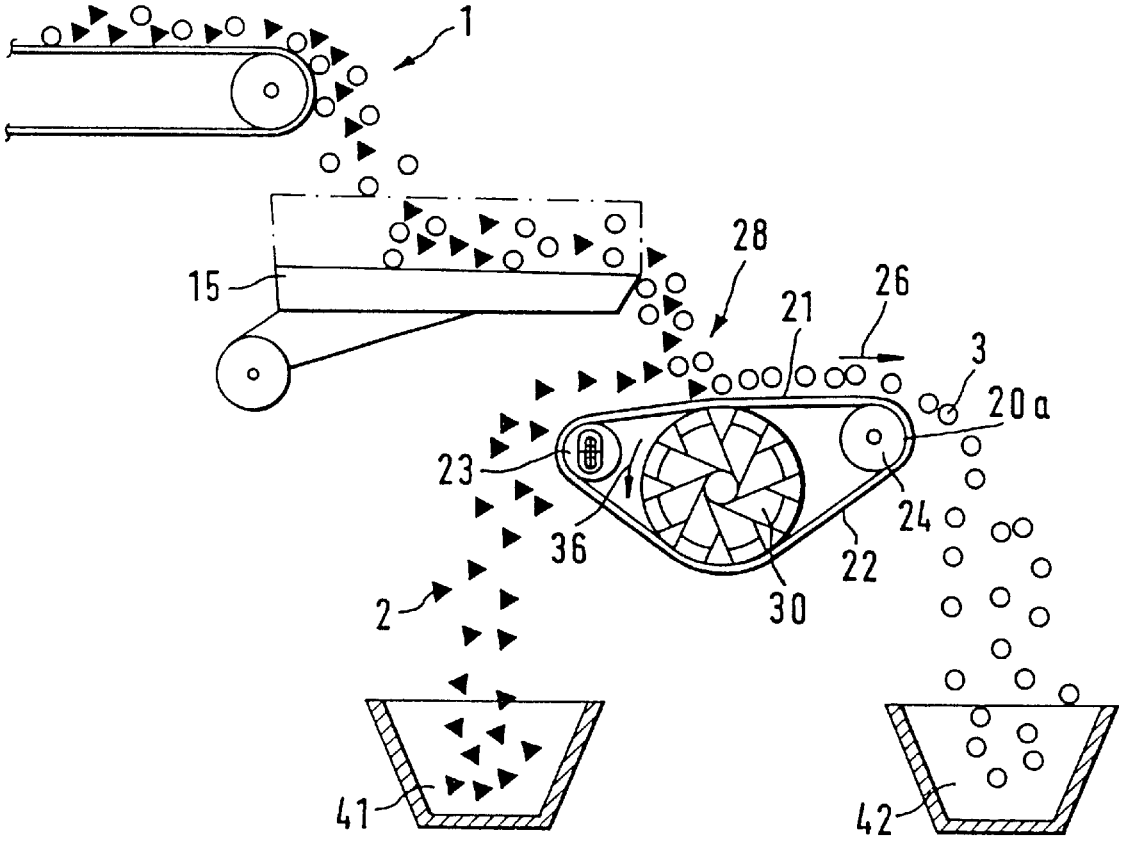
FIG. 3 is a diagrammatic side view of a third embodiment.

In the FIG. 3 embodiment, the mode of operation is substantially the same as in FIG. 2. Here the magnetic system 30 is constructed so that it substantially fills the largest, central drum 25. In addition, the left-hand drum is installed vertically adjustably, so that the inclination of the upper run 21 of the conveyor belt 20*a* can also be adjusted, possibly according to the nature of the mixture of material fed in for sorting.

An embodiment, which is not illustrated, should be mentioned, where the respective directions of movement 26 and 36 of the conveyor belt 20*a* and the surface of the magnetic system 30 are at an angle to each other in addition to the movement in opposite directions. This may sometimes be of interest, as a third type of particle can be extracted if another force component is included.

Figure 5:
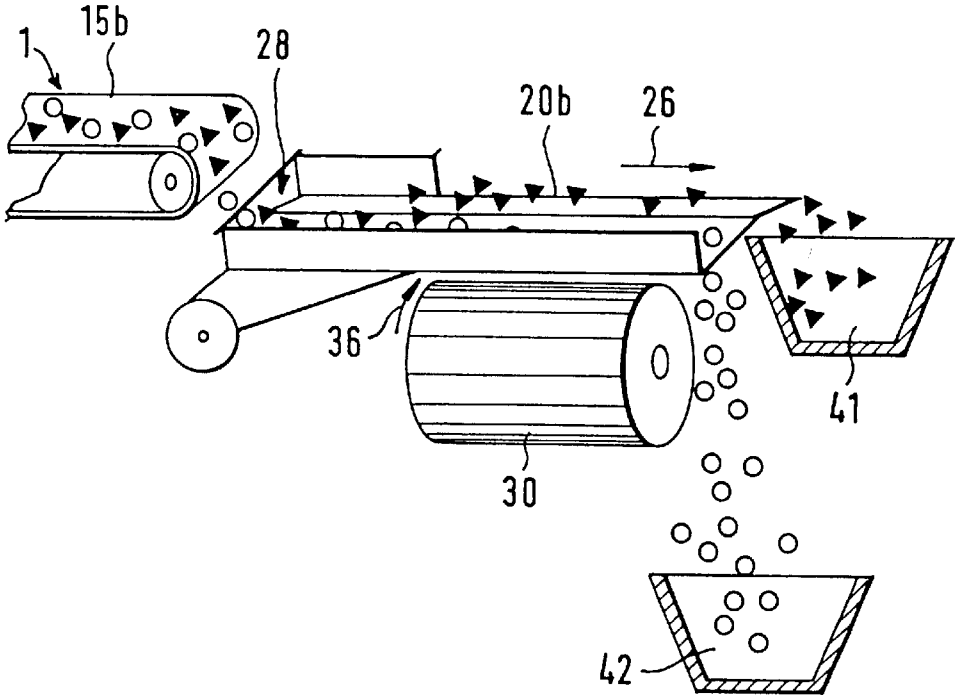
FIG. 5 is a diagrammatic perspective view of the FIG. 4 embodiment.
Figure 4:
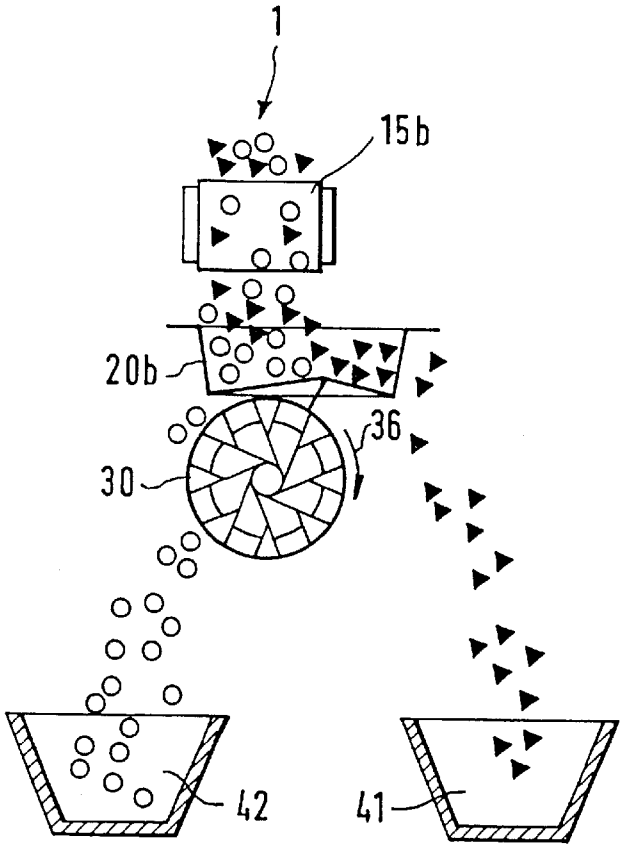
FIG. 4 is a diagrammatic side view of a fourth embodiment.

In the embodiment in FIGS. 4 and 5, the direction of relative movement 26 and 36 of the conveyor 20 and the surface of the magnetic system 30 respectively is also different, though this is for particularly appropriate extraction of non-ferrous metals rather than for extraction of a third type of particle. As described above, the material 1 to be sorted is first taken to the feed point 28 by a conveyor belt 15*b.* At the feed point 28, the as yet unsorted material drops onto a channel conveyor 20*b.* This can be made to convey the particles 2,3 of material 1 lying on it, e.g. by means of a vibrator (not shown) or simply by suitably slanting and inclining the conveyor. The magnetic system 30 is again arranged below the channel conveyor 20*b.* In this case however, its axis of rotation is parallel with the direction in which the particles are conveyed on the conveyor 20*b.* Consequently the direction of movement 36 of the magnetic system 30—or more specifically of its surface—is perpendicular to the direction of movement 26 of the material 1 on the conveyor 20.

In this way, the non-ferrous metals are thrust laterally downwards in this same direction of movement 36 by the conveyor 20, or here the channel conveyor 20*b,* and drop into a collecting container 41 standing next to the conveyor 20*b.* The other components of the material 1 however travel to the end of the conveyor 20*b* and only drop into a collecting container 42 when they reach the end. In the diagrammatic section and elevation in FIG. 4, this process can be seen as taking place and how it would appear from the right in FIG. 5. As indicated in the drawing, the conveyor 20 or the channel conveyor 20*b* is also displaceable and adjustable both vertically and laterally. With this precise adjustment it may even be possible to separate different non-ferrous metals from each other on the conveyor 20, e.g. to separate aluminum and tin, which practitioners have hitherto thought impossible. The vertical adjustability and lateral displaceability of the channel conveyor relative to the magnetic system 30 may in fact bring the forces acting on the different components of the material 1 into play in such a way that certain forces are sufficient to push a specific type of material down from the conveyor and leave another type on it.

The embodiment in FIGS. 6 to 9 is similarly designed to that in FIGS. 4 and 5. A second magnetic system 38 is additionally provided therein, with a direction of movement 39 for the surface above the conveyor 20, which is in this embodiment a channel conveyor 20*b.* In this way, the effect of the two magnetic systems 30 and 38 on the particles moving between them is made much more equal. This is partly because the second magnetic system 38 above the channel conveyor 20*b* can now reliably influence rolling or rebounding particles of material 1, which could hitherto still evade action by the first magnetic system 30 or which were difficult to sort because of their rebounding action and other particular irregularities. The stronger effect of the two magnetic systems is shown graphically by the larger angles in FIG. 9. The axes of the two magnetic systems 30 and 38 are parallel with each other and also with the conveying direction on the conveyor 20*b.* They could possibly be at certain angles, especially if additional, possibly complex sorting effects seem appropriate. Thus, particle separation may even be carried out with waste materials including lead being sorted so that the lead containing particles are separated from the others. It might even be possible to sluice out non-ferrous metals such as gold or silver from sand.

Figure 11:
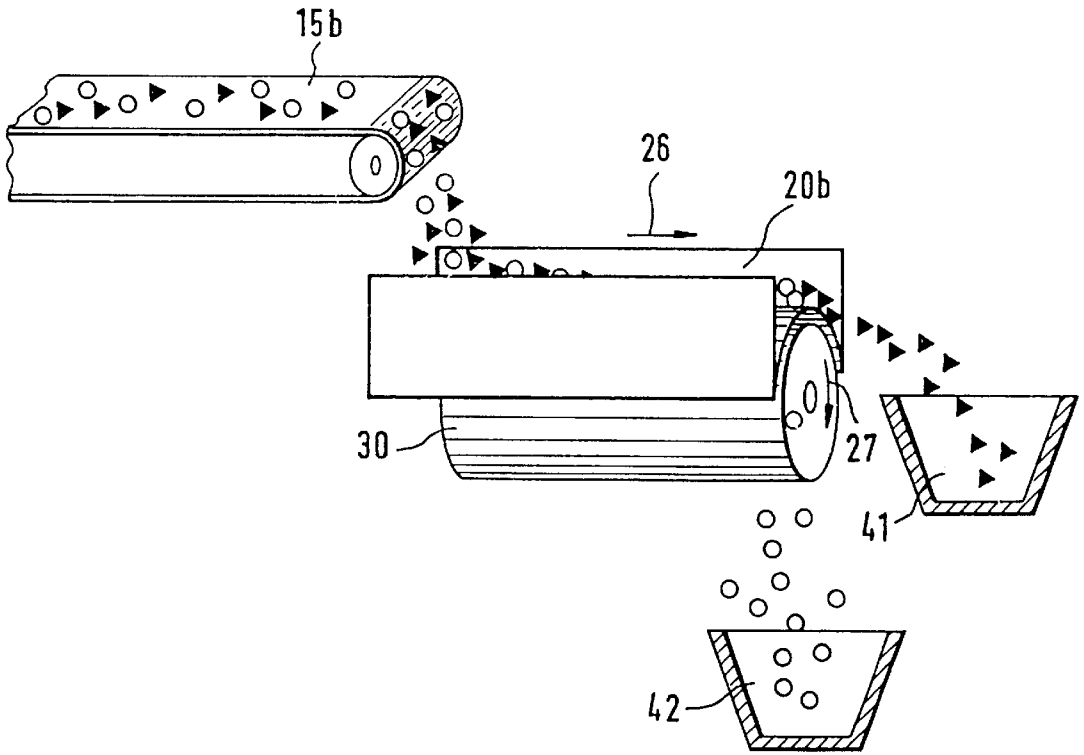
FIG. 11 is a diagrammatic perspective view of the FIG. 10 embodiment.
Figure 10:
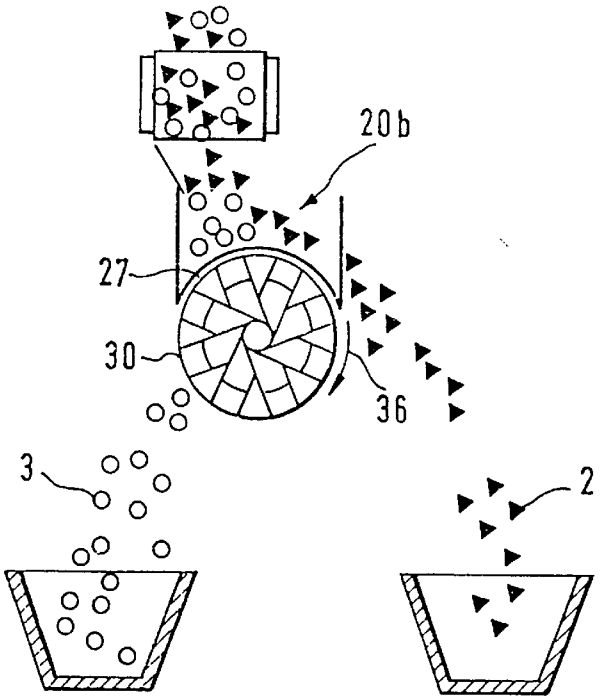
FIG. 10 is a diagrammatic section through a sixth embodiment.

The embodiment in FIGS. 10 and 11, like that in FIGS. 4 and 5, has a channel conveyor 20*b* with a non-level base 27. In this case however, the non-level base 27 is not only slightly raised at the center, but the whole base is curved upwardly like a segment of a circle. Hence the particles come particularly close to the magnetic field, which is thus utilized more effectively. The drum 30, which is immediately below the particles, rotates transversely to their conveying direction, so that particles of one type gather in the relatively acute angle formed between the base 27 and one sidewall, and particles of the other type gather at exactly the opposite side. Here again, parts of the sidewall may of course be specifically left out, so that particles can be channeled out if this seems appropriate and if the materials definitely contain no particles, which would then tend to cling to the drum surface.

Figure 13:
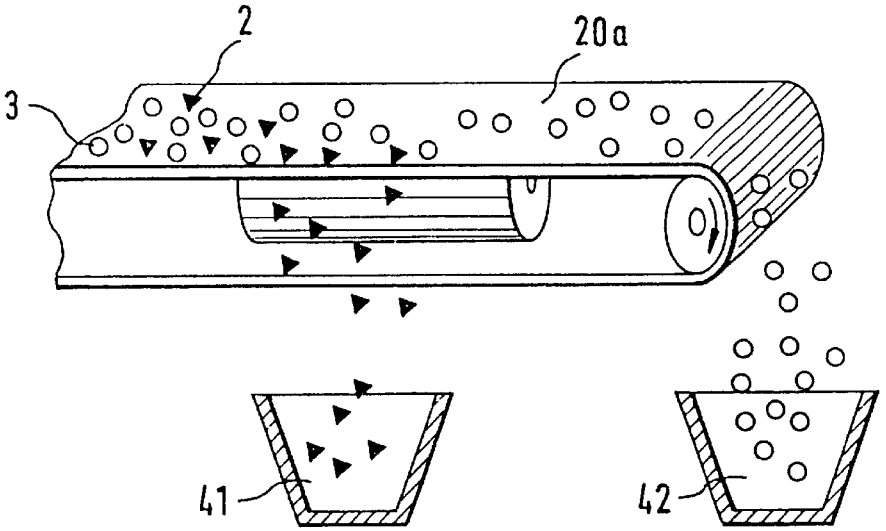
FIG. 13 is a diagrammatic perspective view of the FIG. 12 embodiment.
Figure 12:
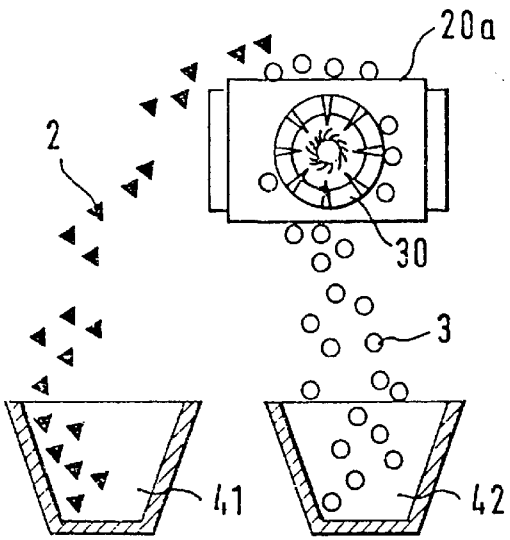
FIG. 12 is a diagrammatic section through a seventh embodiment.

FIGS. 12 and 13 show another embodiment in which a conveyor belt 20*a* rather than a channel conveyor moves, its conveying direction 26 likewise being perpendicular to the direction of movement 36 of the drum surface. Similar advantages are obtained with the belt construction.

Figure 14:
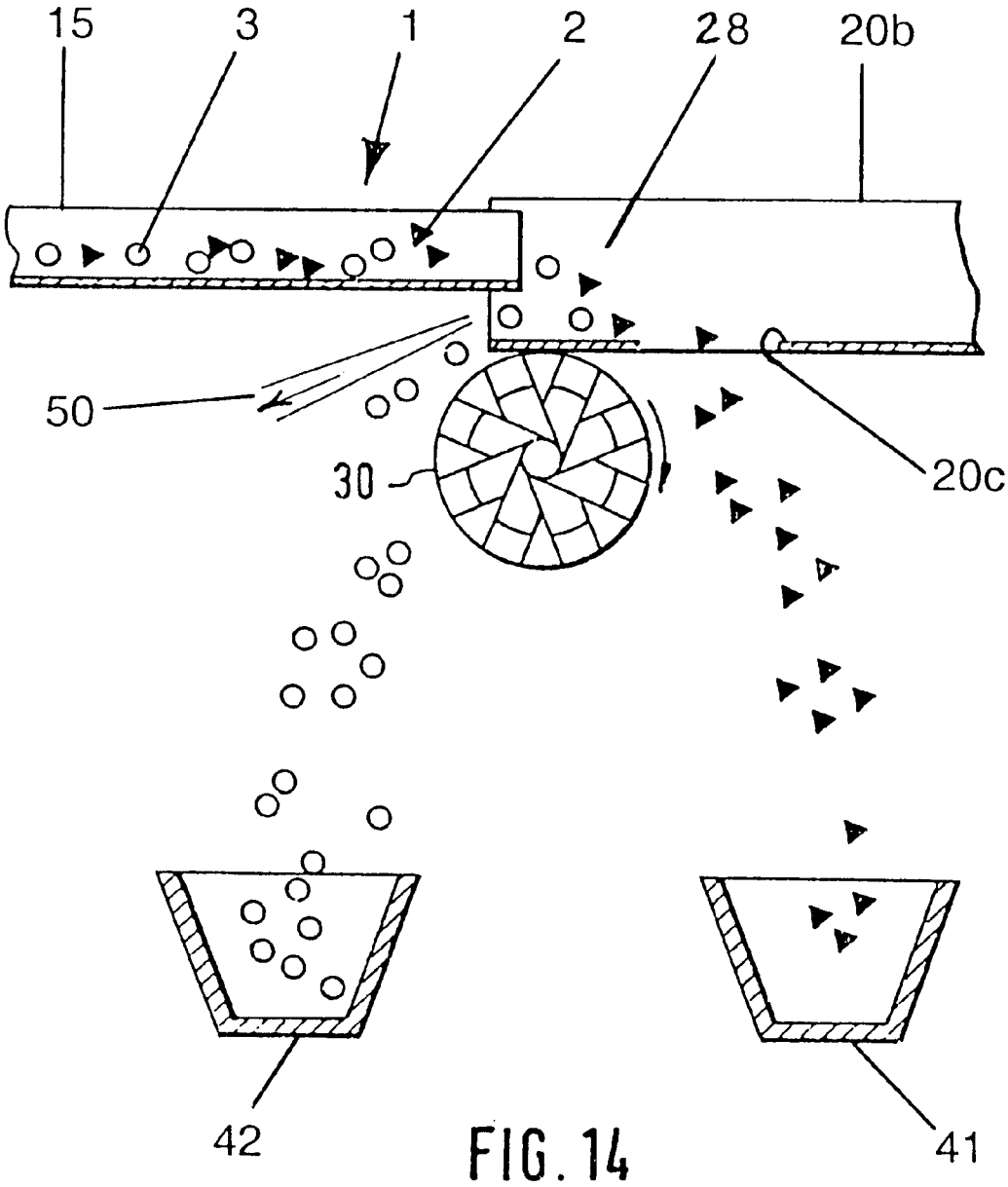
FIG. 14 is a diagrammatic section through an eighth embodiment.

In the embodiment shown in FIG. 14 fluid from a fluid supply means 50, e.g. air from an appropriate nozzle, is additionally applied to the particles 2,3 above the magnetic system. In this way, more detailed specifications for the sorting of the particles can be followed. This version may be combined with any of the other embodiments.

What is claimed is:

1. Apparatus for separating mixed particles of material having different electrical conductance comprising:

a conveyor device onto which the particles are fed, said conveyor device having first and second ends, said conveyor device having an elongated conveyor surface extending between said first and second ends, said conveyor surface moving said particles in a first direction from said first end to said second end;

a particle feed device positioned above said conveyor device configured to feed said particles onto said conveyor surface of said conveyor device at a feed point located intermediate said first and second ends;

a rotating magnetic system arranged in spaced relation below the conveyor surface of the conveyor device, and further arranged in alignment with said feed point, said rotating magnetic system having an outer surface which rotates in a second direction perpendicular to said first direction, said rotating magnetic system having an axis of rotation that is parallel to said first direction and perpendicular to said second direction, said rotating magnetic system being configured to produce a magnetic force which acts on a predetermined portion of said particles to move said predetermined portion of said particles across said conveyor surface in a second direction; and at least two distinct collecting containers for collecting a separated particle fraction.

2. The apparatus of claim 1 wherein the conveyor device comprises is a conveyor belt.

3. The apparatus of claim 2 wherein the conveyor belt has an upper run and a lower run, said conveyor belt being mounted on at least first and second drums, said apparatus comprising distinct and separate first and second collecting containers being arranged below and adjacent to the respective drums.

4. The apparatus of claim 1 wherein the conveyor device comprises a channel conveyor constructed of a non-conductive material.

5. The apparatus of claim 4 wherein said channel conveyor comprises a vibrating channel conveyor.

6. The apparatus of claim 5 wherein said channel conveyor is inclined.

7. The apparatus of claim 4 wherein said channel conveyor is inclined.

8. The apparatus of claim 4 wherein the channel conveyor has first and second sides, said first side having a side wall, said second side having no side wall such that non-ferrous metal particles can be separated out over that side.

9. The apparatus of claim 4 wherein the channel conveyor has a non-level base portion when viewed in a cross-section taken transverse to the conveying direction.

10. The apparatus of claim 9 wherein said non-level base having a high point in a central region thereof.

11. The apparatus of claim 10 wherein the base has a shape that matches an outer peripheral shape of the drum.

12. The apparatus of claim 11 wherein the axis of the rotating magnetic system is parallel to said first direction of movement of said surface of said conveyor, said conveyor being arranged closely above and laterally offset from said magnetic system but overlapping with the uppermost peripheral part thereof.

13. The apparatus of claim 1 wherein a position of said conveyor is adjustable relative to said magnetic system.

14. The apparatus of claim 13 wherein said conveyor is vertically adjustable relative to said magnetic system.

15. The apparatus of claim 14 wherein said conveyor is laterally adjustable relative to said magnetic system.

16. The apparatus of claim 13 wherein said conveyor is laterally adjustable relative to said magnetic system.

17. The apparatus of claim 1 further comprising a fluid feed means provided in the region above the rotating magnetic system.

18. Apparatus for separating mixed particles of material having different electrical conductance comprising:

a conveyor assembly, said conveyor comprising first and second drums which define first and second ends of said conveyor assembly, and a conveyor belt mounted on said first and second drums, said conveyor belt having an elongated conveyor surface extending between said first and second ends, said conveyor surface moving said particles in a first direction from said first end to said second end;

a rotating magnetic system mounted beneath said conveyor belt between said first and second drums, said rotating magnetic system having an outer surface which rotates in a second direction which is perpendicular to said first direction, and imposes a magnetic force also perpendicular to said first direction, said rotating magnetic system having an axis of rotation that is parallel to said first direction, said rotating magnetic system being configured to produce a magnetic force which acts on a predetermined portion of said particles to move said predetermined portion of said particles across said conveyor surface in a second direction; and distinct and separate first and second collecting containers for collecting a separated particle fraction.

19. Apparatus for separating mixed particles of material having different electrical conductance comprising:

an elongated channel conveyor onto which the particles are fed, said channel conveyor moving said particles in a first direction, said channel conveyor having a bottom wall with opposing side edges, said channel conveyor further including a side wall extending upwardly from said first side edge of said bottom wall;

a rotating magnetic drum mounted beneath said channel conveyor, said magnetic drum having a surface which rotates in a second direction which is perpendicular to said first direction, said second direction extending towards said second side edge of said bottom wall;

a first collecting container positioned at a terminal end of the channel conveyor adjacent said first side edge of said bottom wall; and a second collecting container.

20. The apparatus of claim 19 wherein said bottom wall of said channel conveyor is inclined.

21. The apparatus of claim 20 wherein said channel conveyor is vibrated to induce movement of said particles in said first direction.

22. The apparatus of claim 19 wherein said bottom wall of said channel conveyor has an elevated central portion which angles downwardly towards said first and second side edges.

23. The apparatus of claim 22 wherein said channel conveyor is vibrated to induce movement of said particles in said first direction.

24. The apparatus of claim 19 wherein said bottom wall of said conveyor channel is semi-circular in shape when view in a transverse cross-section, said rotating magnetic drum having a diameter which is generally similar to that of a radius of curvature of the bottom wall of the conveyor channel, said rotating magnetic drum being mounted in closely spaced relation to the underside of said bottom wall, said conveyor channel further comprising a second side wall extending upwardly from said second side edge of said bottom wall, said second collecting container being positioned at a terminal end of the channel conveyor adjacent said second side edge of said bottom wall.

* * * * *